US007587970B2

(12) United States Patent
Hinrichs et al.

(10) Patent No.: US 7,587,970 B2
(45) Date of Patent: Sep. 15, 2009

(54) RECIPROCATING PISTON MACHINE

(75) Inventors: Jan Hinrichs, Friedrichsdorf (DE); Andre Speck, Malsch (DE); Peter Barth, Bielefeld (DE)

(73) Assignee: LuK Fahrzeug-Hydraulik GmbH & Co. KG, Bad Homburg (DE)

( * ) Notice: Subject to any disclaimer, the term of this patent is extended or adjusted under 35 U.S.C. 154(b) by 228 days.

(21) Appl. No.: 11/666,801

(22) PCT Filed: Oct. 20, 2005

(86) PCT No.: PCT/DE2005/001868

§ 371 (c)(1),
(2), (4) Date: May 1, 2007

(87) PCT Pub. No.: WO2006/047984

PCT Pub. Date: May 11, 2006

(65) Prior Publication Data

US 2007/0264136 A1 Nov. 15, 2007

(30) Foreign Application Priority Data

Nov. 5, 2004 (DE) ..... 10 2004 053 482

(51) Int. Cl.
*F04B 27/16* (2006.01)
*F04B 27/10* (2006.01)

(52) U.S. Cl. ..... 92/12.2; 417/222.2

(58) Field of Classification Search ..... 92/12.2, 92/71; 417/222.2, 269
See application file for complete search history.

(56) References Cited

U.S. PATENT DOCUMENTS

| | | | | |
|---|---|---|---|---|
| 6,164,252 | A | 12/2000 | Kuhn et al. | 123/56.3 |
| 6,705,841 | B2 * | 3/2004 | Pawelski et al. | 91/499 |
| 7,179,063 | B2 * | 2/2007 | Casar et al. | 92/12.2 |
| 7,490,540 | B2 * | 2/2009 | Schwarzkopf | 92/12.2 |
| 2004/0007126 | A1 | 1/2004 | Parsch | 92/13 |

FOREIGN PATENT DOCUMENTS

| | | |
|---|---|---|
| DE | 102 07 608 A1 | 2/2003 |
| WO | WO 99/24715 | 5/1999 |
| WO | WO 02/38959 A1 | 5/2002 |

* cited by examiner

*Primary Examiner*—Thomas E Lazo
(74) *Attorney, Agent, or Firm*—Davidson, Davidson & Kappel, LLC

(57) ABSTRACT

A reciprocating piston machine, such as an air-conditioning compressor for motor vehicles, including a pivot ring and a guide sleeve that is provided axially slidably on a drive shaft and is provided with radially projecting bearing sleeves. The pivot ring and the guide sleeve are interconnected by pins so as to be rotatable relative to each other while being axially joined in a fixed manner, the pins being mounted in bores of the pivot ring and in bores of the bearing sleeves of the guide sleeve.

18 Claims, 5 Drawing Sheets

RECIPROCATING PISTON MACHINE

The present invention relates to a reciprocating piston machine, such as an air-conditioning compressor for motor vehicles, having a pivot ring and a guide sleeve which is disposed axially slidably on a drive shaft and has radially projecting bearing sleeves, the pivot ring and the guide sleeve being interconnected by pins which are supported, on the one hand, in bores of the pivot ring and, on the other hand, in bores of the bearing sleeves of the guide sleeve in such a way that they are rotatable relative to each other, but are axially "fixed" to each other.

BACKGROUND

Reciprocating piston machines of this kind are generally known. However, there are some disadvantages associated therewith. For example, the related-art reciprocating piston machines have a one-piece guide sleeve which is manufactured as a lathe-cut part and thus requires a considerable amount of machining. In addition, during operation, these guide sleeves produce traces of wear on the drive shaft of the machine.

Moreover, between the bearing sleeves of the guide sleeve and the pivot ring, the known machines have a spherical-segment shaped contact surface, which is expensive to manufacture, but is necessitated by the annular inner circumferential wall of the pivot ring, in order to allow an unhindered motion of the pivot ring relative to the bearing sleeves.

Also, in the known machines, the press-fit connection between the pins and the bearing sleeves is disadvantageously configured in the guide sleeve, which can lead to associated tolerance problems. Thus, narrow tolerances are required between the pins and the bearing sleeves due to the coaxiality of the fixed cylinder-pin location holes, and, on the other hand, substantial play is created by the rotatable cylinder-pin location holes in the pivot ring, which can lead to associated noise and vibration problems.

SUMMARY OF THE INVENTION

It is, therefore, an object of the present invention to devise a reciprocating piston machine which will overcome these disadvantages.

The present invention provides a reciprocating piston machine, such as an air-conditioning compressor for motor vehicles, having a pivot ring and a guide sleeve which is disposed axially slidably on a drive shaft and has radially projecting bearing sleeves, the pivot ring and the guide sleeve being interconnected by pins which are supported, on the one hand, in bores of the pivot ring and, on the other hand, in bores of the bearing sleeves of the guide sleeve in such a way that they are rotatable relative to each other, but are axially "fixed" to each other, the guide sleeve having a pot-shaped part, in particular of deep-drawn sheet metal, in which the radially projecting bearing sleeves are inserted in radial bores. Here the advantage is derived that virtually no or only relatively little machining is required to manufacture the guide sleeve. It is thus possible to reduce the cost of component parts.

A reciprocating piston machine is preferred in which the material of the pot-shaped part of the guide sleeve is hardened, while the material of the bearing sleeves is not hardened. Here the advantage is derived that the tolerances of the bearing sleeves to be positioned with axial precision are not affected by thermal deformation.

A reciprocating piston machine is also preferred in which the pot-shaped part of the guide sleeve and the bearing sleeve are joined together by connection means, in particular by soldering. This advantageously makes it possible for a hardened and an unhardened component part to be united in a simple and reliable manner to form one assembly.

The reciprocating piston machine according to the present invention that the pot-shaped part of the guide sleeve may have bushings made of friction-bearing material in the guidance portion on the drive shaft. This advantageously minimizes wear to the shaft, since the hardened guide sleeve no longer executes axial movements on the shaft surface. It is thus possible to reduce wear in the guidance portion of the guide sleeve and the drive shaft.

A reciprocating piston machine is also preferred in which a bushing, in particular the bushing on the side where a return spring is located between the guide sleeve and the shaft, is designed as a collared bushing. Here the advantage is derived that this bushing is able to function simultaneously as a limit stop for the return spring, and, consequently, that the return spring, as well, is able to move against an antifriction bearing material while being subject to relatively little wear.

In addition, a reciprocating piston machine is preferred in which the bushings are pressed in place into the pot-shaped part of the guide sleeve. Here the benefit is derived of a simple fastening method that does not require any additional connection means.

A reciprocating piston machine according to the present invention may have the feature that the contact surfaces between the pivot ring and the bearing sleeves of the guide sleeve are constituted of plane surfaces. In this case, one obtains the advantages of reduced wear and simpler parts manufacturing since the contact surface area is larger than that of bearing sleeve surfaces having a spherical segment shape within an annular inner circumferential wall of the pivot ring. The planar contacting instead of the linear contacting also leads to a more efficient damping of the vibrational response between the pivot ring and the bearing sleeves.

A reciprocating piston machine is preferred in which the pivot ring has two flattened wall regions on the annular inner peripheral wall, so that the inner peripheral wall of the pivot ring has the shape of an oval. Thus, the plane contact surface is formed on the pivot ring side.

A reciprocating piston machine is also preferred in which, in the unmachined state, the pivot ring is formed as a forged part. The advantage of such a fabrication process is that it economizes on material and does not require a substantial outlay for machining.

In addition, a reciprocating piston machine is preferred in which the bearing sleeves each have a plane axial (contact) surface.

Another reciprocating piston machine according to the present invention may have the feature that the pins are press-fitted into the bores of the pivot ring and are rotatably supported in the bearing sleeves of the guide sleeve. In this case, the play between the cylinder-pin location hole in the pivot ring and the pins themselves is advantageously avoided, so that the amount of noise and vibration generated may be reduced.

Also preferred is a reciprocating piston machine in which the pins are supported by a convex end portion in the bearing sleeves of the guide sleeve. The narrow tolerances necessitated by the coaxiality of the cylinder-pin location holes may advantageously be avoided, since contacting now takes place at the surface area of the convex end portions, making it possible to compensate for angular errors in the axial direction.

A reciprocating piston machine is also preferred in which the pins, on the longitudinal sides thereof, have two flattened surfaces which are configured in the pivot ring in such a way that the interference fit between the pins and the pivot ring bores does not deform the sliding-shoe bearing surfaces of the pivot ring. A machine is preferred in which the flattened surfaces of the pins are positioned in parallel to the sliding-shoe bearing surfaces of the pivot ring. This makes it possible to advantageously prevent any warping of the sliding-shoe bearing surfaces when the pins are pressed in place.

BRIEF DESCRIPTION OF THE DRAWINGS

The present invention is described in the following with reference to the figures, which show.

DETAILED DESCRIPTION

Figure 1:
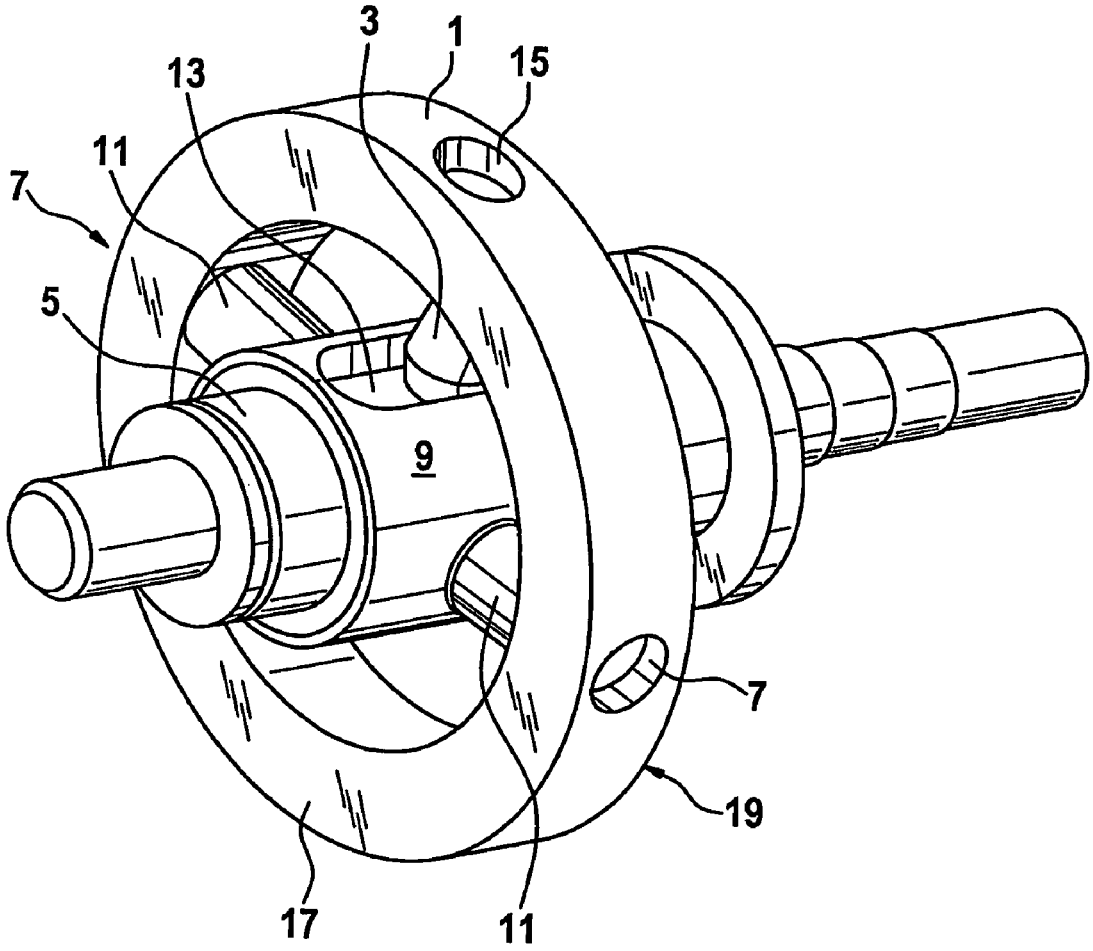
FIG. 1 a pivot ring assembly including the drive shaft and the guide sleeve in accordance with the related art.

FIG. 1 illustrates the assembly of a pivot ring machine according to the related art including drive shaft 5, guide sleeve 9 and pivot ring 1. In response to rotation of drive shaft 5, pivot ring 1 is set into rotation by a driving pin 3 which is fixed to drive shaft 5. In addition, pivot ring 1 has two bores 7 for receiving pins about which the pivot ring is able to execute a rotary motion. Also accommodated on shaft 5 is guide sleeve 9 which has two radially projecting bearing sleeves 11 for receiving the pins. Guide sleeve 9 is slidable on shaft 5. For this purpose, guide sleeve 9 has a recess 13, which allows guide sleeve 9 to be supported axially movably on shaft 5 relative to driving pin 3. Driving pin 3 engages by its upper end in a bore 15 of the pivot ring and allows the pivot ring to execute a pivoting movement to pivot about this upper end of driving pin 3. Piston shoes for the pistons of the reciprocating piston machine which slide on surfaces 17 and 19 of the pivot ring. In this context, the pins supported inside of pivot ring bores 7 and bearing sleeves 11 form a swivel axis for pivot ring 1 that is displaceable in the axial direction of machine shaft 5. The function of such a pivot ring drive for reciprocating piston machines is generally known and described in the related art, so that there is no need for further clarification here.

Figure 2A:
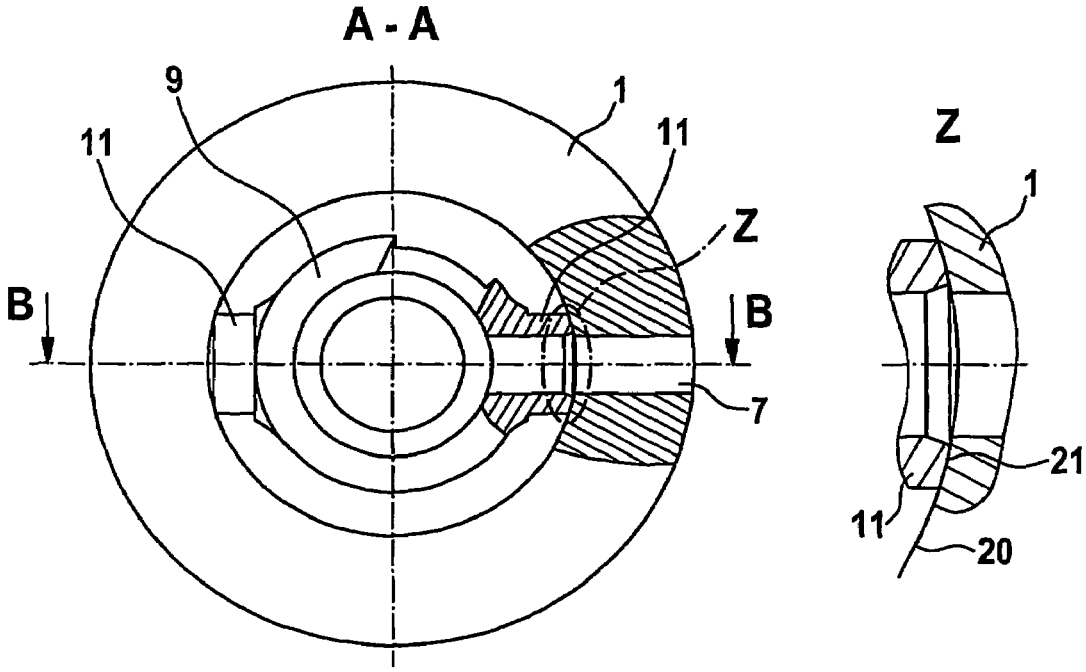
FIGS. 2*a* and 2*b* the contact surface between the bearing sleeves and the pivot ring in accordance with the related art.
Figure 2B:
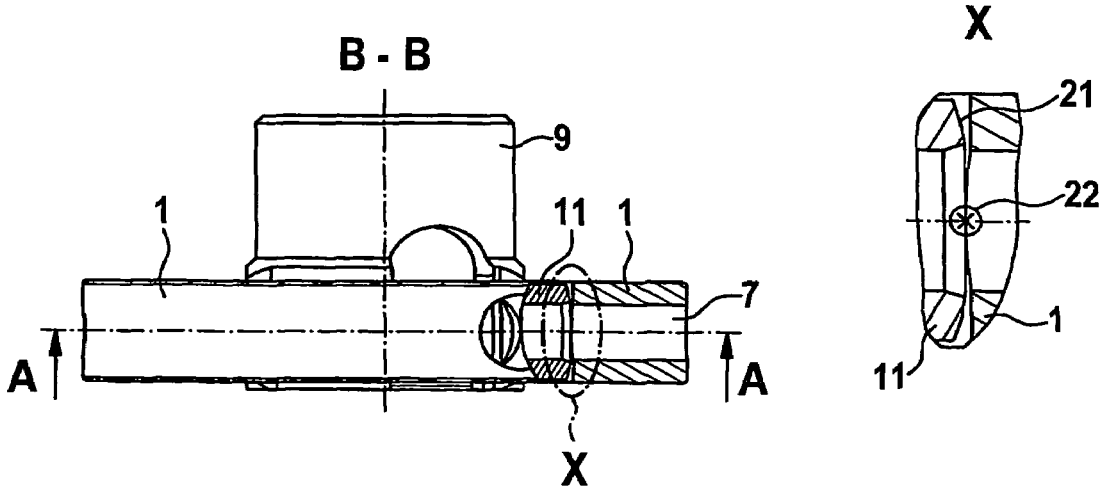
Figure 3A:
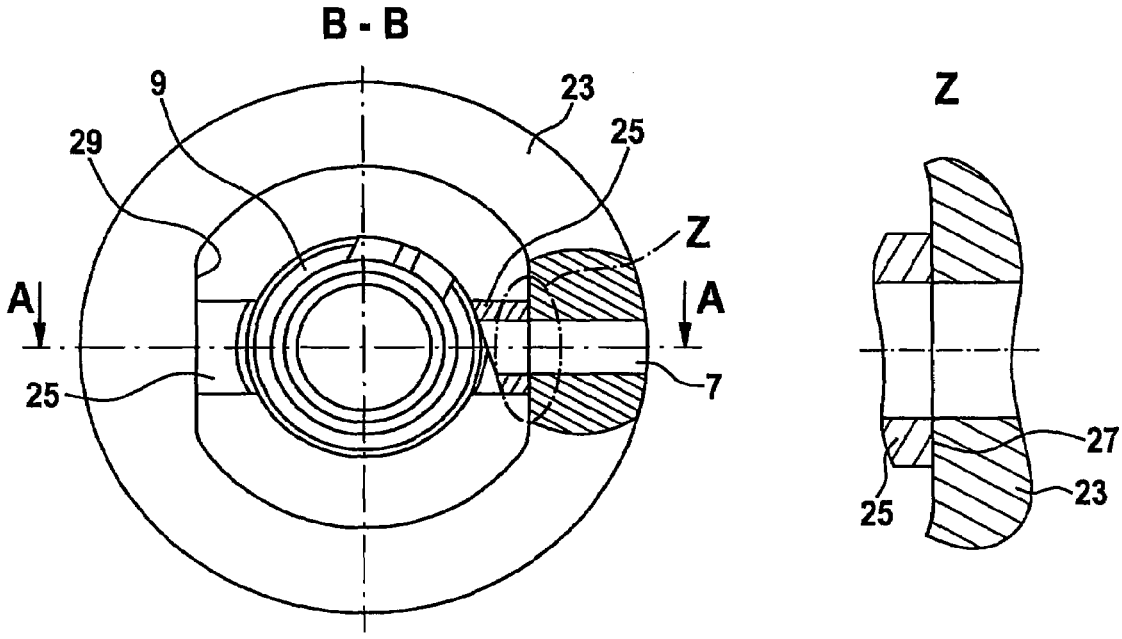
FIGS. 3*a* and 3*b* the contact surfaces between the bearing sleeves and the pivot ring in accordance with the present invention.
Figure 3B:
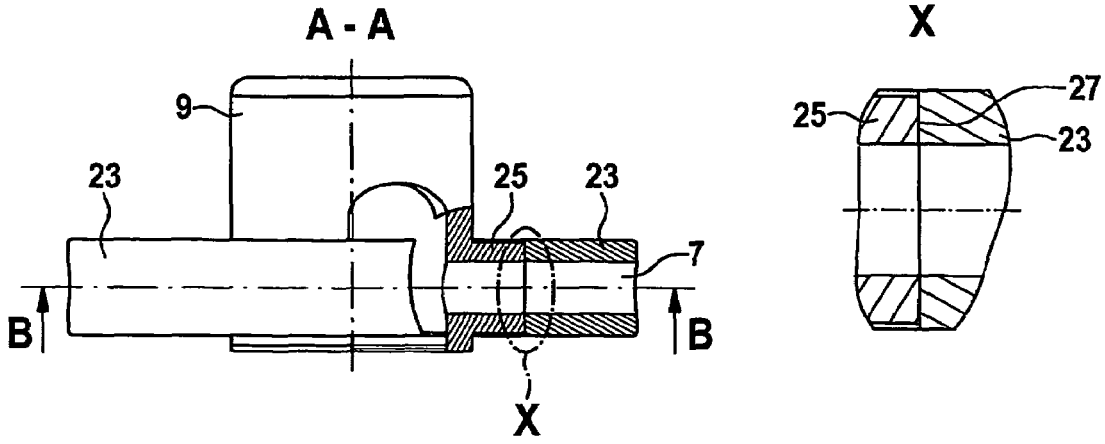

In a plan view, FIG. 2 shows the contact surfaces between pivot ring 1 and bearing sleeves 11 in accordance with the related art. The same components are denoted here by the same reference numerals as in FIG. 1. In FIG. 2*b*, guide sleeve 9 and pivot ring 1 are shown in a plan and part-sectional view. It is discernible, in particular in enlarged representations Z of FIG. 2*a* and X of FIG. 2*b*, that contact surfaces 21 of bearing sleeves 11 contacting pivot ring 1 must have an approximately spherical segment shape, in order not to hinder pivot ring 1, whose inner circumferential surface is circular, in its rotational and slewing motion and to sufficiently support the same. As may be inferred from enlarged representations Z and X, the contact made between the inner circumference of pivot ring 1 and bearing sleeves 11 is a linear contacting represented by line 20 passing orthogonally through point 22. It is also expensive and complicated to manufacture the spherical segment-shaped end faces of bearing sleeves 11. Therefore, FIG. 3 shows the inventive modification to the contact surfaces between improved pivot ring 23 and improved bearing sleeves 25. Bearing sleeves 25 now have a plane surface section 27, while pivot ring 23 likewise has a plane inner peripheral surface at contact surface 27 thereof, inner periphery 29 of improved pivot ring 23 consequently having the shape of an oval. Thus, between pivot ring 23 and bearing sleeves 25, a planar contacting is provided which, due to the larger area of contact, produces less wear than the linear contacting known from the related art (FIG. 2) and renders possible an improved damping in response to vibrations of the pivot mechanism. Moreover, the contact surfaces of bearing sleeves 25 are simpler and less expensive to manufacture. Thus, the contact surfaces between pivot ring 23 and bearing sleeves 25 are planar in both dimensions, as illustrated by enlarged representations Z and X in FIGS. 3*a* and 3*b*.

Two embodiments of the guide sleeve according to the present invention are shown in FIG. 4. The guide sleeve has a pot-shaped part 31, which assumes the function of part 9 of FIG. 1, but in this inventive case, is made of deep-drawn sheet metal, for example, and is thus able to be mass-produced at a lower cost. Guide sleeve part 31 is bearing-supported in bores 33 and 35 on shaft 5 of FIG. 1 and, via these bearings, is slidable on the shaft. A lateral bore 37 in the circumferential wall of guide sleeve part 31 corresponds to bore 13 of guide sleeve 9 of FIG. 1 and thus creates the clearance space required for driving pin 3 of FIG. 1 that extends from shaft 5 into bore 15 of pivot ring 1 and is configured not to hinder the axial mobility of guide sleeve 31. Accommodated in two radial bores 39 of guide sleeve part 31 are two bearing sleeves 41, which provide guidance for the pins that form a swivel axis for pivot ring 1. While guide sleeve part 31 may be made of hardened, deep-drawn sheet steel in order to increase strength and reduce wear, bearing sleeves 41 may remain in the unhardened state and are, therefore, not subject to the inherent deformation risks of a thermal treatment process. Bearing sleeves 41 may be fastened in guide sleeve part 31 using connection means, such as soldering.

Figure 4A:
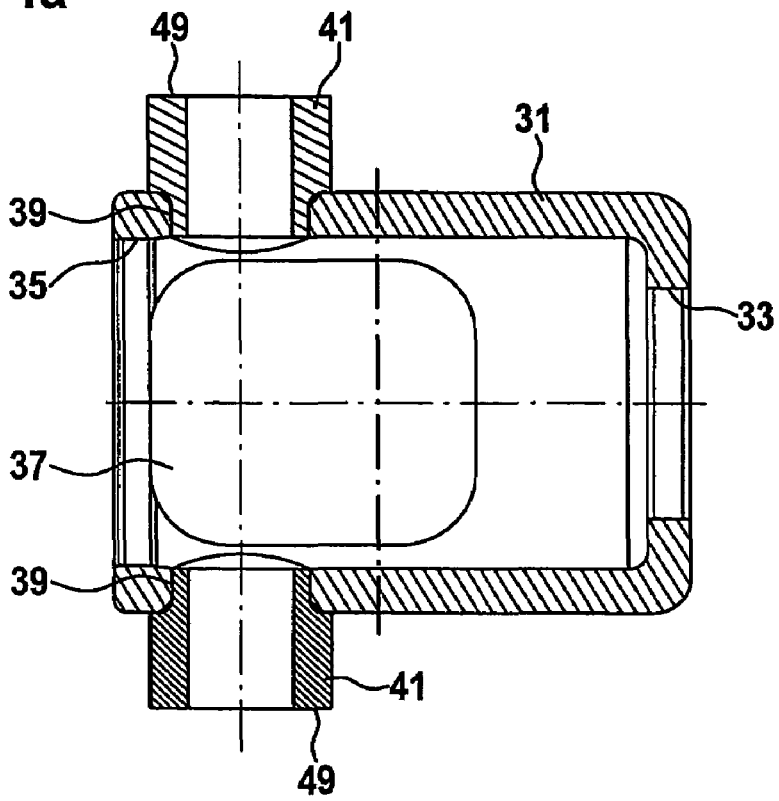
FIGS. 4*a* and 4*b* a guide sleeve according to the present invention.
Figure 4B:
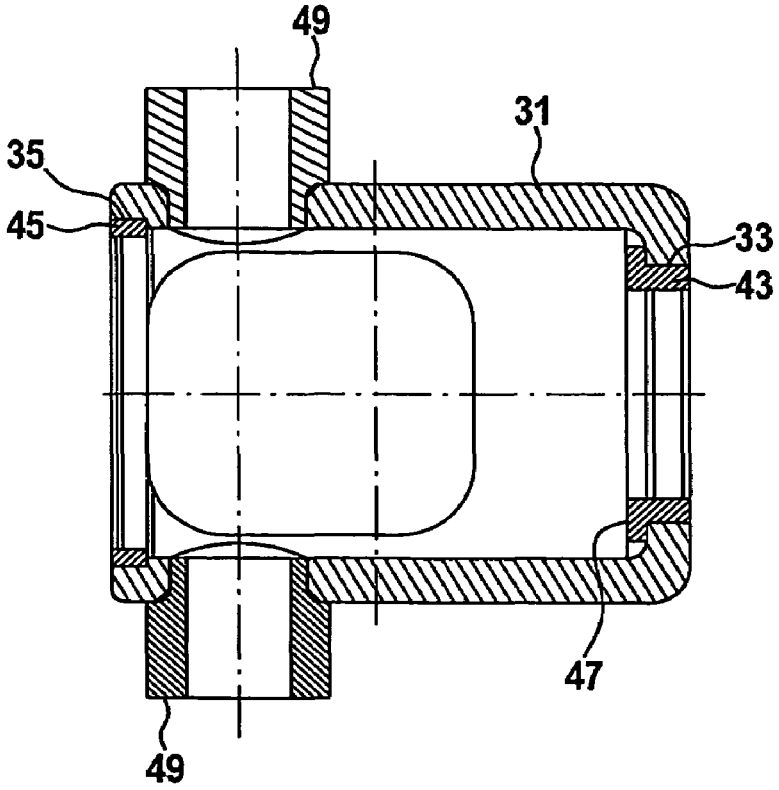

Also introduced into guide sleeve part 31 in FIG. 4*b* are two bushings made of a friction-bearing material. Thus, for example, bore 33 has a collared bushing 43 inserted therein, which, on the one hand, acts as a friction bearing against shaft 5 and, on the other hand, together with collar 47, forms a limit stop for a return spring, which, when the compressor is at a standstill, presses the pivot ring into a starting position. Inserted into bore 35 is a second friction-bearing bushing 45. Wear to the shaft, as encountered in related art methods, is avoided through the use of friction-bearing bushings 43 and 45. Also discernible in FIGS. 4*a* and 4*b* is plane contact surface 49 according to the present invention, as already depicted in FIG. 3 as contact surface 27. Friction-bearing bushings 43 and 45 may be fastened using joining techniques, such as press-fitting of the same in guide sleeve part 31.

Figure 5:
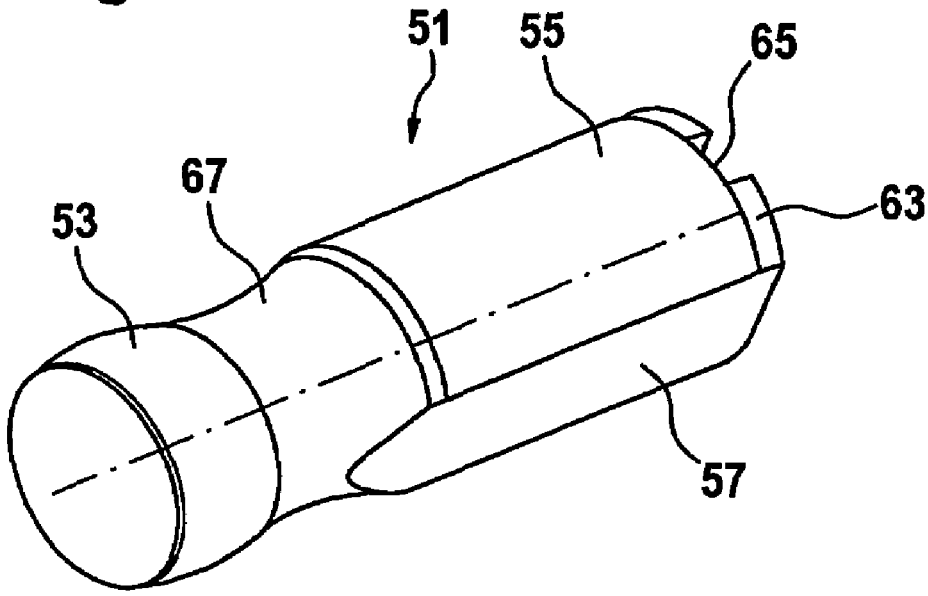
FIG. 5 a pin according to the present invention for press-fitting into the pivot ring.
Figure 6:
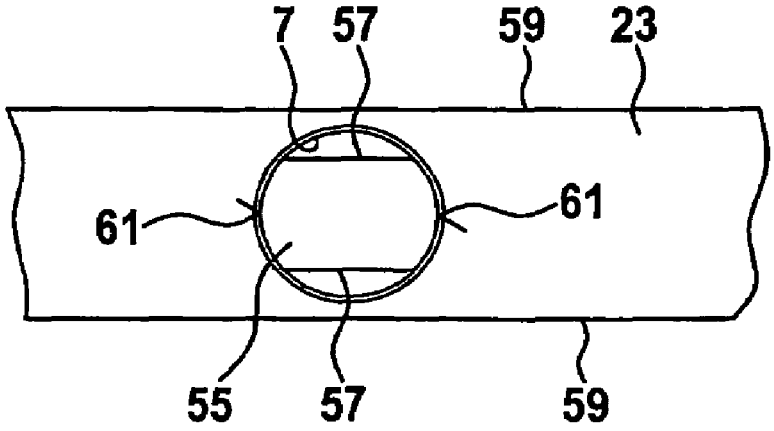
FIG. 6 the interference fit between the pivot ring and a pin according to the present invention.

In a perspective view, FIG. 5 shows one of the two pins 51, which, together with guide sleeve 9, form the swivel axis of pivot ring 1 in the pivot ring mechanism. In this context, pins 51 are press-fitted in the pivot ring, into bores 7 of FIG. 3, and supported by their spherical segment-shaped end portions 53 in bearing sleeves 25 in FIG. 3, respectively 41 in FIG. 4. Cylindrical section 55 of pins 51 that is press-fittable in pivot ring 23 into bores 7 thereof has two flat portions 57, which, in FIG. 6, are positioned in pivot ring 23 to extend in parallel to sliding surfaces 59 of pivot ring 23. Sliding shoes, which are suitably supported in the axially reciprocating pistons of the reciprocating piston machine, glide on sliding surfaces 59 of the pivot ring. In FIG. 6, it is discernible that the interference fit between pins 51 and cylindrical end section 55 thereof and pivot ring 23 is only effected at lateral surfaces 61 and, thus, that that area of bore 7 in pivot ring 23 which faces sliding surfaces 59 is not deformed by the pressing in place of pins 51. Thus, in comparison to the related art, pins 51, as shown in FIGS. 5 and 6, are designed in such a way that the interference fit is shifted from guide sleeve 9 into pivot ring 23, and a convex contact region is formed between bearing sleeves 25 of guide sleeves 9 and cylindrical pins 51. Noted advantages are a broadening of tolerances with respect to the pin guidance in bearing sleeves 25 and, at the same time, a reduced play in the entire assembly between guide sleeve 9, cylindrical pins 51 and pivot ring 23. These measures result in reduced costs, a simplified assembly and, at the same time, in an improved noise and vibrational response of the pivot ring drive. Cylindrical pins 51 may also be optionally produced using deep-drawn blanks. To facilitate insertion of cylinder pin 51 during the press-fit operation, also discernible in FIG. 5 in end region 63 is a grooved end section having a slot 65 for positioning pin 51 during assembly to the desired position, as shown in FIG. 6. A constricted region 67 between part 53 and cylindrical part 55 provides ease of mobility in the transitional region between bearing sleeves 25 and, respectively 41, and pivot ring 23 in FIG. 3.

LIST OF REFERENCE NUMERALS

1 pivot ring
3 driving pin
5 drive shaft
7 bore in the pivot ring
9 guide sleeve
11 bearing sleeve
13 recess for driving pin
15 bore of the pivot ring for driving pin
17 sliding shoe surface of the pivot ring
19 sliding shoe surface of the pivot ring
20 line of contact between the contact surfaces of the pivot ring and bearing sleeve
21 spherical-segment shaped contact surface between the bearing sleeve and the pivot ring
22 pass-through point of the linear contacting
23 improved pivot ring
25 improved bearing sleeve
27 plane surface section of the bearing sleeve/contact surface to the pivot ring
29 inner periphery of the improved pivot ring
31 pot-shaped part of the guide sleeve
33 bearing bore for the shaft
35 bearing bore for the shaft
37 bore for the driving pin
39 radial bore for the bearing sleeves
41 improved bearing sleeves
43 collared-bushing friction bearing
45 friction-bearing bushing
47 collar of the collared bushing
49 plane contact surface of the bearing sleeve
51 cylindrical pins
53 spherical segment-shaped end part of the cylindrical pins
55 cylindrical section of the cylindrical pins
57 flat portions of the cylindrical pins
59 sliding surfaces of the pivot ring for piston shoes
61 lateral surface of pivot ring bore 7
63 end region of cylindrical pins 51
65 positioning slot of the cylindrical pins
67 constricted region of the cylindrical pins

What is claimed is:

1. A reciprocating piston machine comprising:

a pivot ring having pivot ring bores;

a guide sleeve, the guide sleeve being disposed axially slidably on a drive shaft and having radially projecting bearing sleeves, the guide sleeve including a pot shaped part with radial bores, the bearing sleeves inserted in the radial bores, the bearing sleeves having bearing sleeve bores; and pins interconnecting the pivot ring and the guide sleeve, the pins being supported in the bearing sleeve bores and pivot ring bores.

2. The reciprocating piston machine as recited in claim 1 wherein the pivot ring is circumferentially rotatable around the pins to a limited angle relative to the guide sleeve.

3. The reciprocating piston machine as recited in claim 1 wherein the guide sleeve pot-shaped part is made of deep drawn sheet metal.

4. The reciprocating piston machine as recited in claim 1 wherein the material of the pot-shaped part of the guide sleeve is hardened, while the material of the bearing sleeves is not hardened.

5. The reciprocating piston machine as recited in claim 1 wherein the pot-shaped part of the guide sleeve and the bearing sleeves are joined together.

6. The reciprocating piston machine as recited in claim 5 wherein the pot shaped part of the guide sleeve and the bearing sleeves are joined by soldering.

7. The reciprocating piston machine as recited in claim 5 wherein a bushing is designed as a collared bushing.

8. The reciprocating piston machine as recited in claim 7 wherein the bushing is between the guide sleeve and the drive shaft on the side where a return spring is located.

9. The reciprocating piston machine as recited in claim 7 wherein the pivot ring has two flattened wall regions on the annular inner peripheral wall, so that the inner peripheral wall of the pivot ring is oval shaped.

10. The reciprocating piston machine as recited in claim 9 wherein the pins are supported by a convex end portion in the bearing sleeves of the guide sleeve.

11. The reciprocating piston machine as recited in claim 9 wherein the pins have longitudinal sides with have two flattened surfaces configured in the pivot ring that the interference fit between the pins and the pivot ring bores does not deform the sliding-shoe bearing surfaces of the pivot ring.

12. The reciprocating piston machine as recited in claims 5 wherein the bushings are pressed in place into the pot-shaped part of the guide sleeve.

13. The reciprocating piston machine as recited in claims 1 wherein the pot-shaped part of the guide sleeve on the drive shaft has bushings made of friction-bearing.

14. The reciprocating piston machine as recited in claim 1 wherein contact surfaces between the pivot ring and the bearing sleeves of the guide sleeve are plane surfaces.

15. The reciprocating piston machine as recited in claim 1 wherein the pivot ring is a forged part.

16. The reciprocating piston machine as recited in claim 1 wherein the bearing sleeves each have a plane axial contact surface.

17. The reciprocating piston machine as recited in claim 16 wherein the flattened surfaces of the pins are positioned in parallel to the sliding-shoe bearing surfaces of the pivot ring.

18. The reciprocating piston machine as recited in claim 1 wherein the pins are press-fitted in the bores of the pivot ring and rotatably supported in the bearing sleeves of the guide sleeve.

* * * * *